US005890241A

United States Patent [19]

Ball

[11] Patent Number: 5,890,241

[45] Date of Patent: Apr. 6, 1999

[54] METHOD AND MEANS FOR INSTALLING OVERFLOW OUTLETS TO BATHTUBS AND THE LIKE

[75] Inventor: William T. Ball, Leawood, Kans.

[73] Assignee: WCM Industries, Inc., Colorado Springs, Colo.

[21] Appl. No.: 28,297

[22] Filed: Feb. 24, 1998

[51] Int. Cl.[6] ..... F16L 55/10

[52] U.S. Cl. ..... 4/538; 4/679; 4/694; 138/90; 73/49.8

[58] Field of Search ..... 4/538, 584, 679–695; 137/797; 138/90; 73/49.1, 49.8

[56] References Cited

U.S. PATENT DOCUMENTS

| | | | |
|---|---|---|---|
| 2,444,340 | 6/1948 | Donahue | 4/680 |
| 3,493,978 | 2/1970 | Hindman et al. | 4/694 |
| 4,446,583 | 5/1984 | Dean | 4/694 |
| 4,739,799 | 4/1988 | Carney et al. | 138/90 |
| 4,848,155 | 7/1989 | Huber | 4/683 |
| 4,936,350 | 6/1990 | Huber | 138/90 |
| 5,163,480 | 11/1992 | Huber | 138/90 |
| 5,273,077 | 12/1993 | Oropallo | 138/90 |
| 5,507,501 | 4/1996 | Palmer | 73/49.8 |

*Primary Examiner*—Charles R. Eloshway
*Attorney, Agent, or Firm*—Zarley, McKee, Thomte, Voorhees & Sease

[57] ABSTRACT

An overflow system for a bathtub has an overflow port and has a drain pipe in connection with the overflow port. A flexible diaphragm is secured to and seals the port by a plate having a center opening. The diaphragm seals the overflow port when the system is being tested for leaks with pressurized fluid. Following the test, when the fluid is removed, the diaphragm is cut or slashed to open the overflow port to provide fluid flow. A cap covering the plate and the diaphragm is secured to the drain pipe and covers the plate and the diaphragm.

10 Claims, 2 Drawing Sheets

METHOD AND MEANS FOR INSTALLING OVERFLOW OUTLETS TO BATHTUBS AND THE LIKE

BACKGROUND OF THE INVENTION

In new building construction, the plumbers prefer not to put the finished closure valves in the bottom of tubs, or the finished decorative plate over the overflow outlet at the end of the tub until the project is finished because these elements will be often damaged as the construction project is brought to a close. Further, the piping for both of the outlets need to be checked for leaks before the inspection process is completed. The test involves running water down the vent for the drain until it reaches a level above the tub and the tester then determines whether any of the piping leaks. Thus, when the testing operation arrives, a plug is put in the bottom drain of the tub and some sort of a seal plate is placed at the end of the tub on the overflow outlet.

Existing overflow plates have a center opening therein. There are either two or four small screw holes in the plate adjacent the center opening wherein two of the holes are used to hold the plate to the plumbing fixture. In some cases there is a fitting so that the screw hole is located directly in the middle of the access hole. In that case, that hole is in the way when the testing procedure is implemented. In any event, the testing procedure usually involves stuffing a balloon through the large center opening into the pipe in the wall and the pipe is sealed when the balloon is inflated. Further, existing seal plates normally have to be removed when the decorative plate is put on. The decorative plate is typically held by two screws which either use the screw openings of the plate or two additional openings in the case that four holes are provided.

It is, therefore, a principal object of this invention to provide a method and means for installing an overflow outlet for bathtubs which will safeguard the overflow system during construction; prepare the system for testing; and facilitate the final installation of the bathtub hardware.

A further object of the invention is to facilitate the testing procedure of the overflow system before the final installation has taken place.

A still further object of this invention is to remove anything from the overflow port to make it operational.

These and other objects will be apparent to those skilled in the art.

SUMMARY OF THE INVENTION

An overflow system for a bathtub has an overflow port and has a drain pipe in connection with the overflow port. A flexible diaphragm is secured to and seals the port by a plate having a center opening. The diaphragm seals the overflow port when the system is being tested for leaks with pressurized fluid. Following the test, when the fluid is removed, the diaphragm is cut or slashed to open the overflow port to provide fluid flow. A cap covering the plate and the diaphragm is secured to the drain pipe and covers the plate and the diaphragm.

DESCRIPTION OF THE PREFERRED EMBODIMENT

Figure 1:
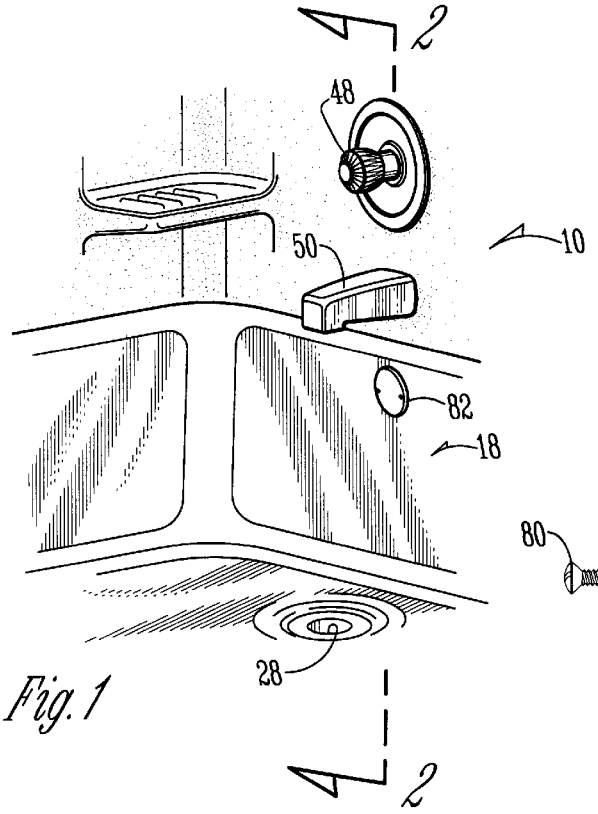
FIG. 1 is a partial perspective view of a conventional bathtub environment utilizing the invention of this application.
Figure 2:
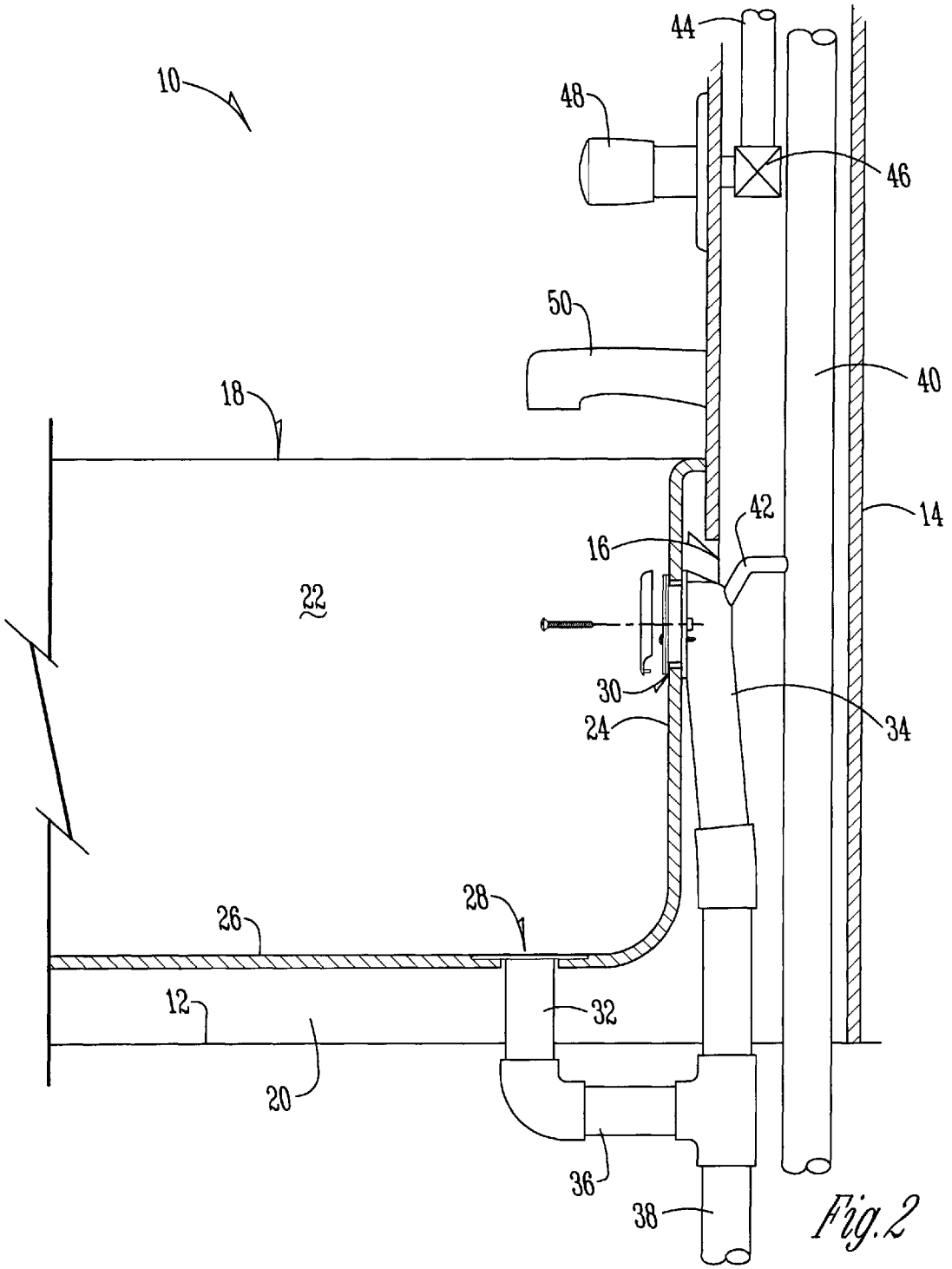
FIG. 2 is a large scale sectional view taken on line 2—2 of FIG. 1.

With reference to FIGS. 1 and 2, a conventional bathroom structure 10 has a floor 12, and a hollow wall 14 with a wall opening 16 therein. A conventional bathtub ("tub") 18 has a base 20 which rests upon floor 12. Sidewalls 22 extend upwardly from base 20 as does an end wall 24. A bottom 26 dwells in spaced relation to the floor 12.

A conventional drain port 28 is located in bottom 26. A conventional overflow port 30 is located in the end wall 24 (FIG. 2). A vertical drain pipe 32 extends downwardly from drain port 28, and overflow drain pipe 34 extends downwardly from overflow port 30. A horizontal pipe 36 connects pipes 32 and 34. A drain pipe 38 extends downwardly from the junction between pipes 34 and 36.

Figure 3:
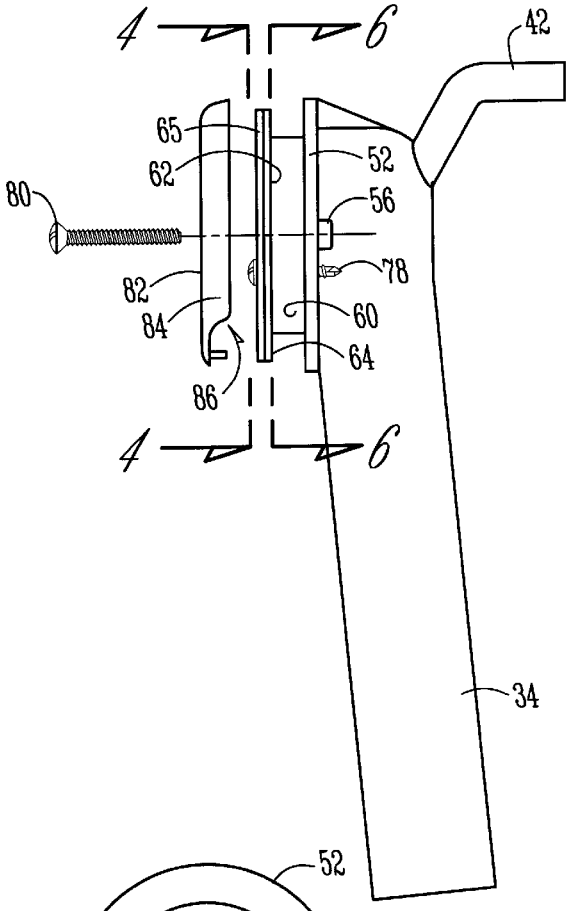
FIG. 3 is a smaller scale exploded side elevational view of the overflow drain of FIG. 2.
Figure 4:
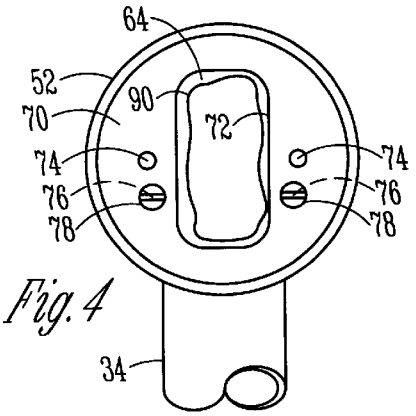
FIG. 4 is en elevational view taken on line 4—4 of FIG. 3.
Figure 6:
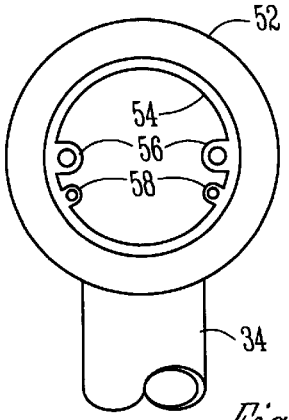
FIG. 6 is an elevational view taken on line 6—6 of FIG. 3.
Figure 5:
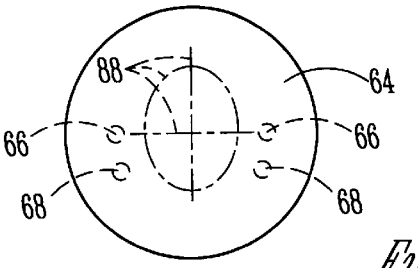
FIG. 5 is an elevational view of the diaphragm element of this invention.

A conventional vertical vent pipe 40 is located within the hollow wall 14. Pipe 42 interconnects vent pipe 40 and the upper end of overflow drain pipe 34 (FIGS. 2 and 3). Conventional water pipes 44 extend through hollow wall 40 and are connected to valve 46 which is interconnected to conventional control member 48 and faucet 50.

With reference to FIGS. 3–6, a plate 52 is formed on the upper end of pipe 34 and has a center opening 54. Pairs of tabs 56 and 58 are located on the inner end of sleeve 60 which extends inwardly from the center opening 54 of plate 52. The numeral 62 designates the inner end or face of sleeve 60.

A diaphragm 64 comprised of flexible rubber or the like is imposed over overflow port 30 and engages the inner face 62 of sleeve 60. Diaphragm 64 can have pairs of apertures 66 and 68 which are in alignment with the perforated tabs 56 and 58, respectively. A plate 70 (FIG. 4) is superimposed over diaphragm 64. Plate 70 has a center opening 72 and apertures 74 and 76 which are in alignment with apertures 66 and 68, respectively. Screws 78 (FIG. 3) extend through plate 70, diaphragm 64, and into the tabs 58 previously described. Similarly, screws 80 extend through suitable apertures in cap 82, thence through apertures 76 in plate 70, and thence into the perforated tabs 56 on plate 52. Cap 82 has a conventional side rim 84 which extends around over the plate 70 and diaphragm 64. A cut out portion 86 in the bottom of cap 82 provides a fluid inlet port for the cap which permits any water at the level of cut out portion 86 to enter within the cap 82 and move upwardly into contact with the diaphragm 64.

In operation, the drainage system comprising the ports 28 and 30, and pipes 34, 36 and 38 are installed as shown in FIG. 2. Vent pipe 40 and connecting pipe 42 are also installed.

In the conventional testing procedure, the port 28 is plugged in any convenient manner. The diaphragm 64 and plate 70 are installed over the overflow port 30 as described above so there is no fluid access to the upper end of pipe 34 either inwardly or outwardly out of overflow port 30. The diaphram 70 is either factory installed or put in place at the construction location. The vent pipe is charged with water at some elevation above pipe 42 so that the building inspectors can check to see if there are any leaks in the system. Having determined that there are no leaks, the water is purged from the system. The plumber can then approach overflow port 30, and by using a knife or any other sharp object, cuts can be made in diaphragm 64 as shown by the dotted lines 88 in FIG. 5 or the cut out portion 90 shown in FIG. 4. This can be quickly and easily done without disassembling any of the structure. Any valve linkage elements required may be installed through cuts 88 on portion 90. The cap 82 is then put in place with the screws 80 as previously described.

It is, therefore, seen that the diaphragm 64 eliminates any need to remove any sealing component from overflow port 30 after the testing procedure has taken place. Further, it facilitates the testing procedure by sealing overflow port 30.

It is, therefore, seen this invention will achieve at least all of its stated objectives.

What is claimed is:

1. An overflow system for a bathtub which has a bottom, and adjacent side and endwalls, a drain port in the bottom, and overflow port in an endwall, with said overflow port being in communication with a vent pipe, comprising, a drain pipe adapted to be in communication with said drain port and said overflow port, a flexible diaphragm element adapted to be secured to and cover said overflow port to permit said system to be pressure tested, said diaphragm being of a moisture impervious material;

wherein, after said system is pressure tested, said diaphragm is can be cut with a knife or the like to open said overflow port to conditions of possible fluid flow.

2. The device of claim 1 wherein said diaphragm is sandwiched in between a plate with a center opening and said overflow port.

3. The device of claim 2 wherein said plate is secured to a drain plate, and has first mounting holes therein, threaded screws securing said plate and said diaphragm to said drain pipe, and second mounting holes in said plate to permit a cap element to be mounted over said secured plates.

4. The device of claim 3 wherein said cap has a fluid access port therein and defines a fluid flow path from said fluid access port to the cut in said diaphragm through the center opening in said plate.

5. An overflow system for a bathtub which has a bottom, and adjacent side and endwalls, a drain port in the bottom, and overflow port in an endwall, with said overflow port being in communication with a vent pipe, comprising, a drain pipe adapted to be in communication with said drain port and said overflow port, a plate with a center opening adapted for connection to said overflow port, a flexible diaphragm element adapted to be secured to and cover said overflow port to permit said system to be pressure tested, said diaphragm being cut to open said center opening of said plate to conditions of possible fluid flow after said system is pressure tested.

6. The device of claim 2 wherein a cap element with a fluid access port therein extends over said plate and said diaphragm and defining a fluid flow path from said fluid access port to the cut in said diaphragm.

7. The device of claim 6, wherein said diaphragm is sandwiched in between said plate with a center opening and said overflow port.

8. A method of installing an overflow system for an overflow port of a bathtub which has a bottom, and adjacent side and endwalls, a drain port in the bottom, and overflow port in an endwall, with said overflow port being in communication with a vent pipe, comprising, placing a flexible diaphragm over said overflow port to seal the same against fluid flow therethrough, subjecting said diaphragm to fluid pressure in a direction towards said tub from outside said tub, removing said fluid pressure, and cutting said diaphragm to open said diaphragm and said overflow port to conditions of possible fluid flow therethrough.

9. The method of claim 8 wherein a cap element with a fluid access port therein is placed over said diaphragm and said overflow port and secured thereto, and providing a fluid flow path from said fluid access port to the cut in said diaphragm.

10. A method of installing an overflow system for an overflow port of a bathtub which has a bottom, and adjacent side and endwalls, a drain port in the bottom, and overflow port in an endwall, with said overflow port being in communication with a vent pipe, comprising, placing a flexible diaphragm over said overflow port to seal the same against fluid flow therethrough, and cutting said diaphragm to open said diaphragm and said overflow port to conditions of possible fluid flow therethrough.

* * * * *

UNITED STATES PATENT AND TRADEMARK OFFICE

CERTIFICATE OF CORRECTION

PATENT NO. : 5,890,241

DATED : April 6, 1999

INVENTOR(S) : William T. Ball

It is certified that error appears in the above-identified patent and that said Letters Patent is hereby corrected as shown below:

Column 3, line 29, strike "can be".

Column 4, claim 8 should be printed as follows:

A method of installing an overflow system for an overflow port of a bathtub which has a bottom, and adjacent side and endwalls, a drain port in the bottom, and overflow port in an endwall, with said overflow port being in communication with a vent pipe, comprising, placing a flexible diaphragm over said overflow port, to seal the same against fluid flow therethrough, subjecting said diaphragm to fluid pressure in a direction towards said tub from outside said tub, removing said fluid pressure, and cutting said diaphragm to open said diaphragm and said overflow port to conditions of possible fluid flow therethrough.

UNITED STATES PATENT AND TRADEMARK OFFICE

CERTIFICATE OF CORRECTION

PATENT NO. : 5,890,241

DATED : April 6, 1999

INVENTOR(S) : William T. Ball

It is certified that error appears in the above–identified patent and that said Letters Patent is hereby corrected as shown below:

Column 4, claim 10, should be printed as follows:

A method of installing an overflow system for an overflow port of a bathtub which has a bottom, and adjacent side and endwalls, a drain port in the bottom, and overflow port in an endwall, with said overflow port being in communication with a vent pipe, comprising, placing a flexible diaphragm over said overflow port to seal the same again fluid flow therethrough, and cutting said diaphragm to open said diaphragm and said overflow port to conditions of possible fluid flow therethrough.

Signed and Sealed this

Seventeenth Day of August, 1999

*Attest:*

Q. TODD DICKINSON

*Attesting Officer*

*Acting Commissioner of Patents and Trademarks*